US006986715B2

(12) United States Patent
Mahaffey

(10) Patent No.: US 6,986,715 B2
(45) Date of Patent: Jan. 17, 2006

(54) GOLF CLUB HEAD WITH A FACE INSERT

(75) Inventor: Steven J. Mahaffey, San Marcos, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/709,902

(22) Filed: Jun. 4, 2004

(65) Prior Publication Data

US 2004/0209704 A1 Oct. 21, 2004

Related U.S. Application Data

(63) Continuation-in-part of application No. 10/361,438, filed on Feb. 10, 2003, now abandoned.

(60) Provisional application No. 60/358,450, filed on Feb. 19, 2002, now abandoned.

(51) Int. Cl.
*A63B 53/02* (2006.01)
*A63B 53/04* (2006.01)

(52) U.S. Cl. ..... 473/305; 473/342; 473/345; 473/349

(58) Field of Classification Search ..... 473/324–350, 473/290–291
See application file for complete search history.

(56) References Cited

U.S. PATENT DOCUMENTS 3,970,236 A 7/1976 Rogers
5,024,437 A 6/1991 Anderson
5,094,383 A 3/1992 Anderson
5,255,918 A 10/1993 Anderson
5,261,663 A 11/1993 Anderson
5,261,664 A 11/1993 Anderson
5,282,624 A 2/1994 Viste
5,425,538 A * 6/1995 Vincent et al. ..... 473/342
5,766,094 A * 6/1998 Mahaffey et al. ..... 473/342
5,827,131 A 10/1998 Mahaffey et al.
6,074,309 A 6/2000 Mahaffey et al.
6,099,414 A * 8/2000 Kusano et al. ..... 473/342
6,354,962 B1 3/2002 Galloway et al.
6,739,984 B1 5/2004 Ciasullo

* cited by examiner

*Primary Examiner*—Sebastiano Passaniti

(74) *Attorney, Agent, or Firm*—Michael A. Catania; Elaine H. Lo

(57) ABSTRACT

A golf club head (20) having a body (22) with a front wall (30) with an opening (32) and a striking plate insert (40) is disclosed herein. The striking plate insert (40) preferably includes an outer layer (61) and an inner layer (65) that are joined together by an explosion bonding process. The inner layer (65) is preferably composed of a material that has a lower yield strength than that of the outer layer (61). The explosion bonding process results in the striking plate insert having an increased yield strength relative to the yield strengths of the individual layers. The golf club head (20) preferably has a moment of inertia, Izz, about the Z axis through the center of gravity of the golf club head ranging from 2700 g-cm$^2$ to 4000 g-cm$^2$.

16 Claims, 7 Drawing Sheets

GOLF CLUB HEAD WITH A FACE INSERT

CROSS REFERENCES TO RELATED APPLICATIONS

The present application is a continuation-in-part application of U.S. patent application Ser. No. 10/361,438, filed on Feb. 10, 2003, claims the benefit of U.S. Provisional Application No. 60/358,450, filed on Feb. 19, 2002, abandoned.

FEDERAL RESEARCH STATEMENT

[Not Applicable]

BACKGROUND OF INVENTION

1. Field of the Invention

The present invention relates to a golf club head. More specifically, the present invention relates to a golf club head with a face insert.

2. Description of the Related Art

High performance drivers employ relatively thin, high strength face materials. These faces are either formed into the curved face shape then welded into a driver body component around the face perimeter, or forged into a cup shape and connected to a body by either welding or adhesive bonding at a distance offset from the face of up to 0.75 inch. In a popular embodiment of the sheet-formed face insert driver, the weld between the formed face insert and the investment cast driver body is located on the striking face, a small distance from the face perimeter. It is common practice for the face insert to be of uniform thickness and to design the surrounding driver body component to be of equal thickness. In this way there is continuity of face thickness across the weld.

Most face inserts are composed of a titanium alloy material. Titanium alloys are generally classified into three types depending on the microstructure of the material developed after processing of the material. The three types are alpha alloys, alpha-beta alloys and metastable beta alloys, and these represent the phases present in the alloy at ambient temperatures. At ambient temperatures, the thermodynamic properties of titanium favors the alpha phase. However, alloying titanium with other elements allows for the high temperature beta phase to be present at ambient temperatures, which creates the alpha-beta and metastable beta microstructures. The metastable phase may be transformed into the alpha phase by heating the alloy to an intermediate elevated temperature, which results in a metastable titanium alloy with increased static strength.

Such high strength metastable titanium alloys have been used as face inserts for drivers with a high coefficient of restitution. However, the heat treatment process compromises the toughness of the material, where toughness is defined as the resistance of the material to fracture under loading. Thus, even heat treated, high strength, metastable titanium alloys have limited application as face inserts due to inferior fracture properties. Thus, there is a need for face inserts composed of titanium alloys with an appropriate microstructure for better fracture properties. This requires a proper balance between strength and toughness (resistance to fracture), without a substantial increase in the costs associated with manufacturing the face insert.

Several patents disclose face inserts. Anderson, U.S. Pat. Nos. 5,024,437, 5,094,383, 5,255,918, 5,261,663 and 5,261,664 disclose a golf club head having a full body composed of a cast metal material and a face insert composed of a hot forged metal material.

Viste, U.S. Pat. No. 5,282,624 discloses a golf club head with a cast metal body and a forged steel face insert with grooves on the exterior surface and the interior surface of the face insert and having a thickness of 3 mm.

Rogers, U.S. Pat. No. 3,970,236, discloses an iron club head with a formed metal face plate insert fusion bonded to a cast iron body.

Galloway, et al., U.S. Pat. No. 6,354,962 discloses a golf club head of a face cup design.

Laminated inserts for golf club heads are well-known in the patented prior art as evidenced by Mahaffey et al., U.S. Pat. Nos. 5,827,131 and 6,074,309. Both patents disclose inserts formed of outer metal layers and an inner layer, where the outer layers are higher density and stronger than the inner layer. The inserts are connected to the golf club head by weld, adhesive, crimping, or other methods known to the art.

It is also known in the art to manufacture certain components of a golf club head using explosion bonding. Ciasullo, U.S. Pat. No. 6,739,984, discloses a golf club head in which a sole plate and top plate each include an inner shell of less dense material which is explosion bonded to the respective plate. The components are then welded together to form a golf club head.

However, there is a need for a golf club head with a face insert that performs better than conventional face insert club heads and provides cost savings.

SUMMARY OF INVENTION

In prior art laminated striking plate inserts for golf club, the bonding strength of the laminate is usually quite low; it is generally lower than the yield strength of the weakest material. Additionally, explosion welding has previously only been used to join the sole plate or the top plate of a golf club head. The present invention overcomes the problems of the prior art by providing a golf club head that has a body with a laminated striking plate insert that is manufactured by an explosion bonding process. The golf club head preferably has a large volume, a large moment of inertia about the center of gravity, a high COR, and a deep face. This allows the golf club head of the present invention to have better performance than a conventional face insert golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
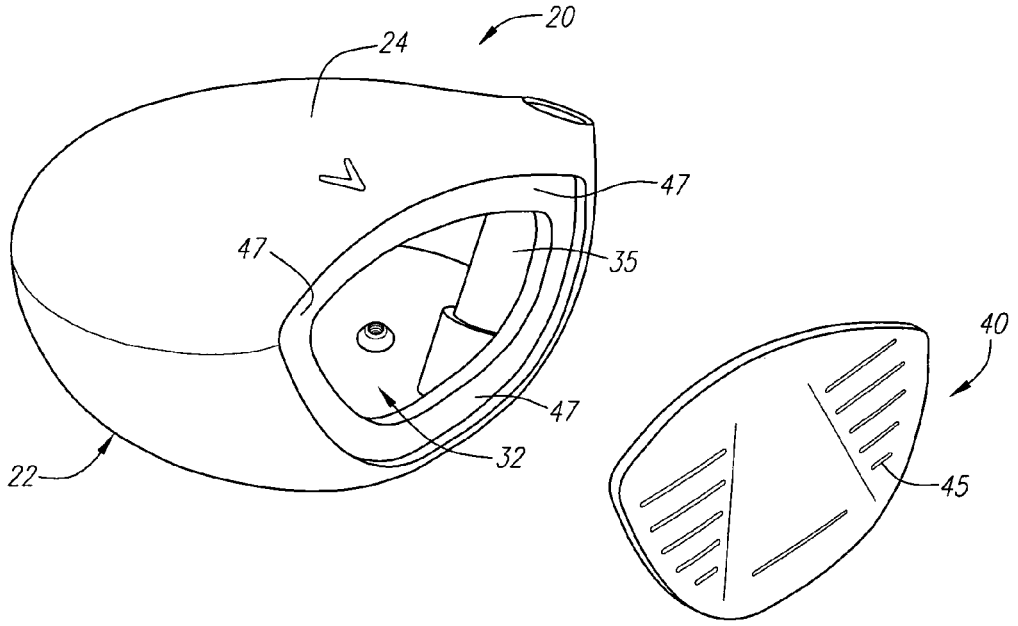
FIG. 1 is an exploded view of the components of a preferred embodiment of the golf club head of the present invention.
Figure 2:
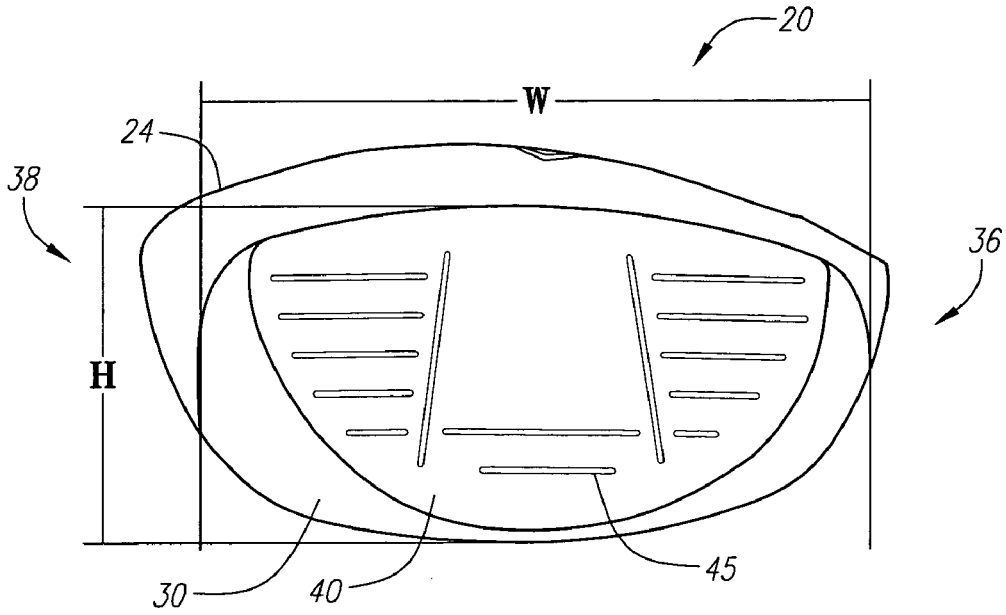
FIG. 2 is a front view of a golf club head of the present invention.
Figure 3:
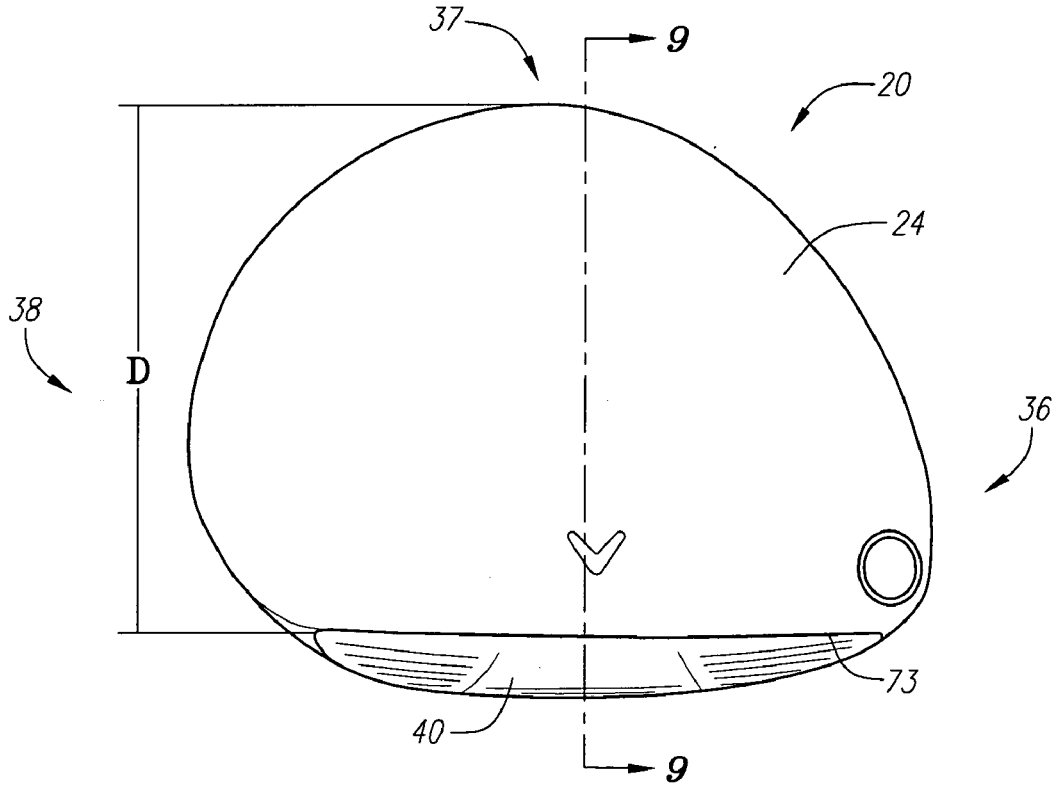
FIG. 3 is a top plan view of a golf club head of the present invention.
Figure 4:
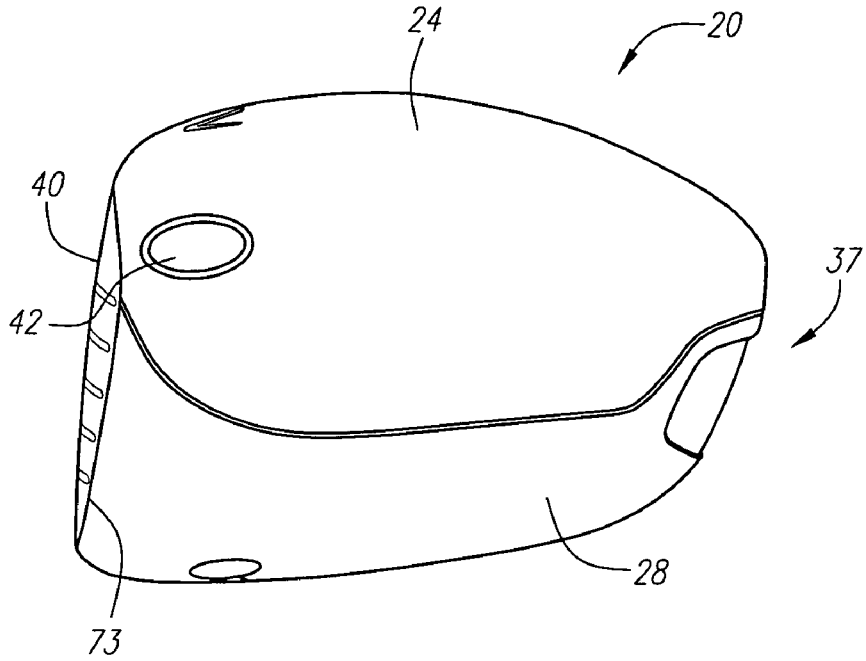
FIG. 4 is a side view of the heel end of a golf club head of the present invention.
Figure 5:
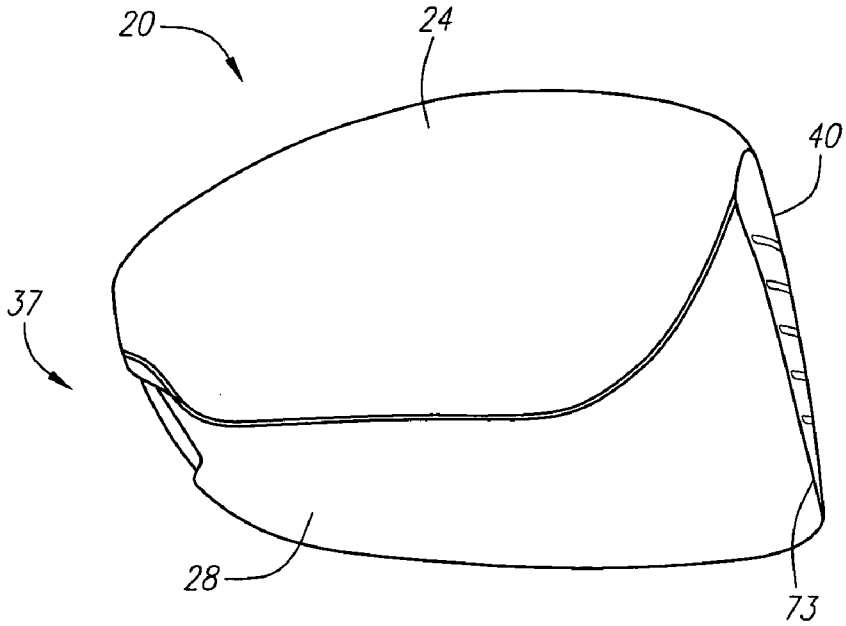
FIG. 5 is side view of the toe end of a golf club head of the present invention.
Figure 6:
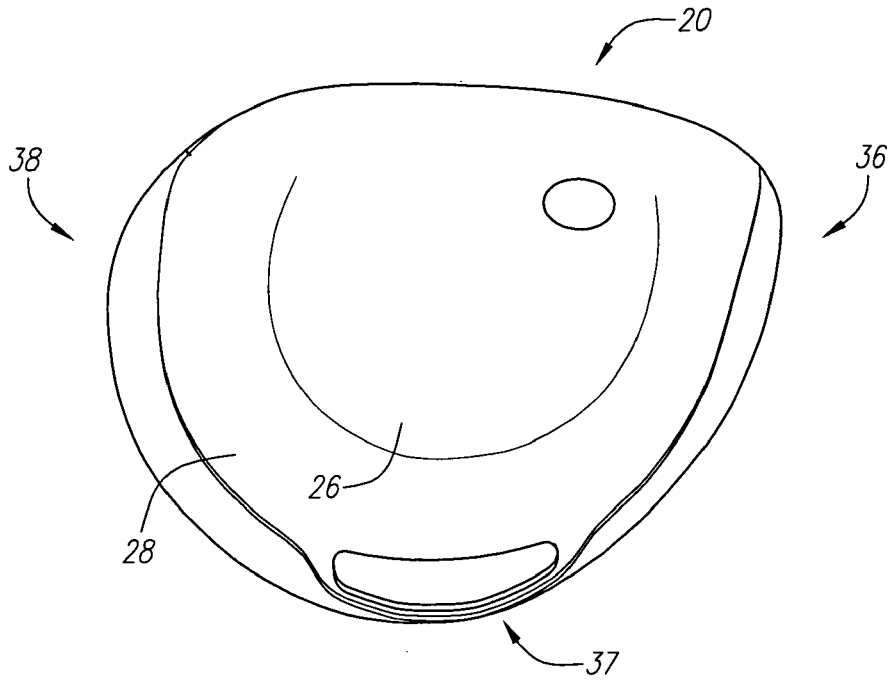
FIG. 6 is a bottom plan view of a golf club head of the present invention.
Figure 7:
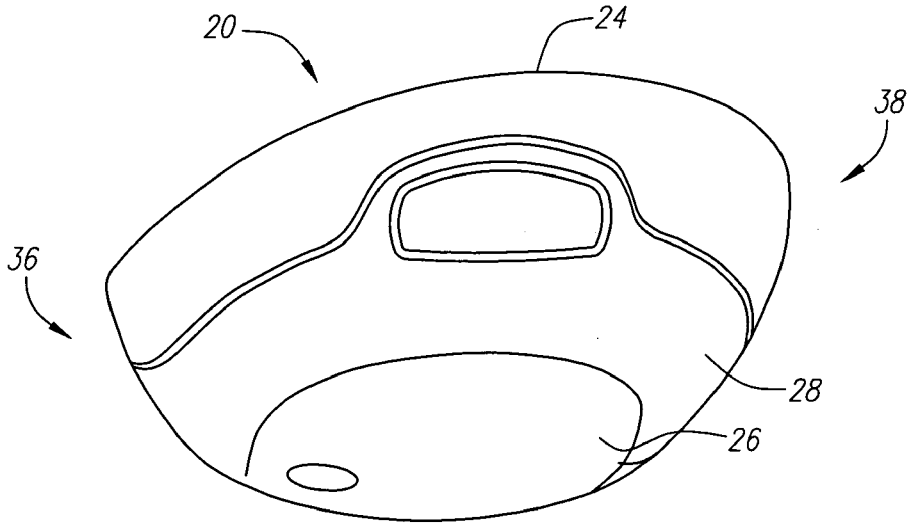
FIG. 7 is a rear view of a golf club head of the present invention.
Figure 8:
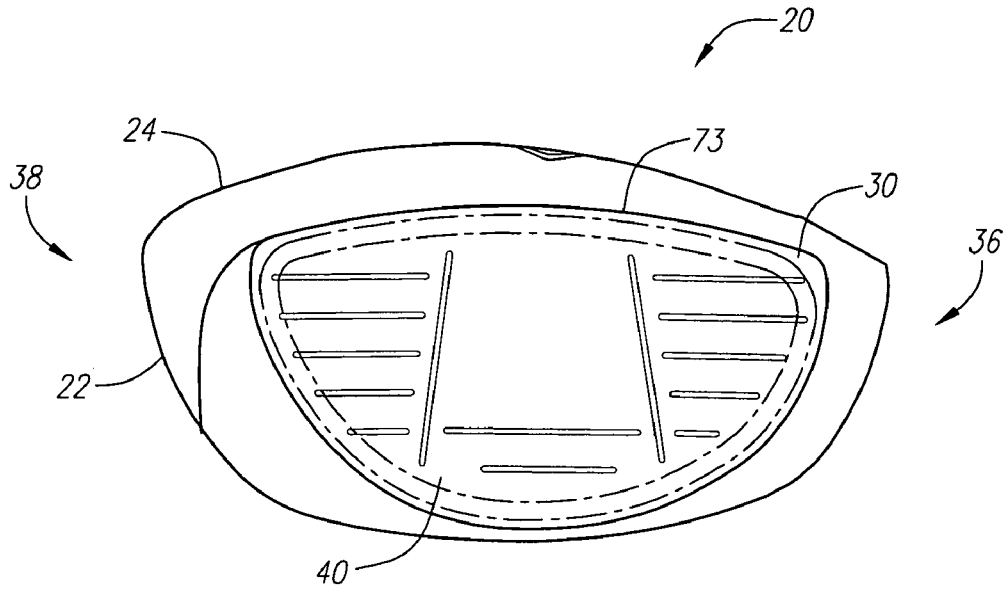
FIG. 8 a front view of a golf club head of the present invention showing the perimeter region in dashed lines.

As shown in FIGS. 1–9, the golf club head of the present invention is generally designated 20. The golf club head 20 of FIGS. 1–9 is a driver, however, the golf club head of the present invention may alternatively be a fairway wood. The golf club head 20 has a body 22 that is preferably composed of a metal material such as titanium, titanium alloy, or the like, and is most preferably composed of a cast titanium alloy material. The body 22 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 22 is composed of 17-4 steel alloy. Additional methods for manufacturing the body 22 include forming the body 22 from a flat sheet of metal, super-plastic forming the body 22 from a flat sheet of metal, machining the body 22 from a solid block of metal, electrochemical milling the body from a forged pre-form, casting the body using centrifugal casting, casting the body using levitation casting, and like manufacturing methods.

The golf club head 20, when designed as a driver, preferably has a volume from 200 cubic centimeters to 600 cubic centimeters, more preferably from 300 cubic centimeters to 460 cubic centimeters, and most preferably from 360 cubic centimeters to 425 cubic centimeters. A golf club head 20 for a driver with a body 22 composed of a cast titanium alloy most preferably has a volume of 380 cubic centimeters. The volume of the golf club head 20 will also vary between fairway woods (preferably ranging from 3-woods to eleven woods) with smaller volumes than drivers.

The golf club head 20, when designed as a driver, preferably has a mass less than 225 grams, and most preferably a mass of 180 to 215 grams. When the golf club head 20 is designed as a fairway wood, the golf club head preferably has a mass of 135 grams to 180 grams, and preferably from 140 grams to 165 grams.

Figure 10:
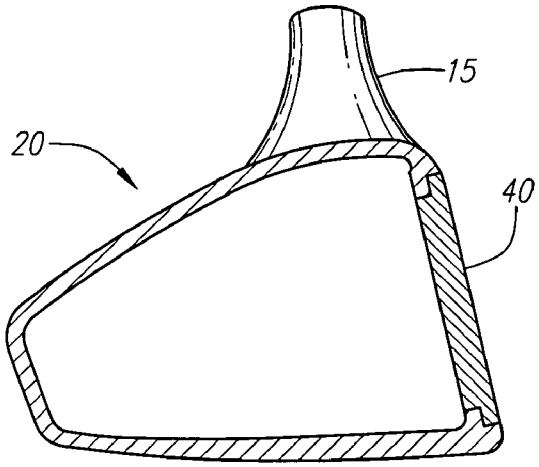
FIG. 10 is a sectional view of an alternative embodiment of a golf club head having a striking plate insert.
Figure 11:
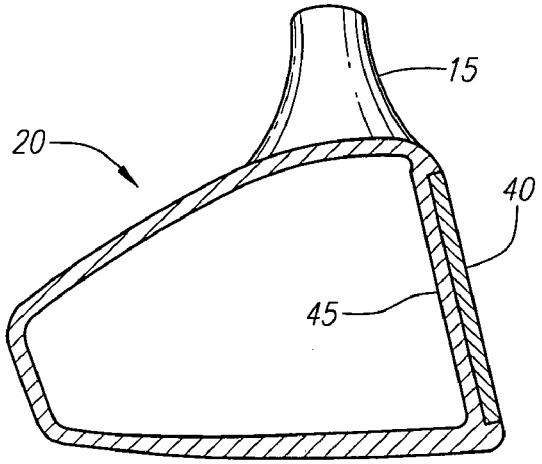
FIG. 11 is a sectional view of an alternative embodiment of a golf club head having striking plate insert.

The body 22 preferably has a crown 24, a sole 26, a ribbon 28, and a front wall 30 with an opening 32 or alternatively with a recess 45. The body 22 preferably has a hollow interior 34. The golf club head 20 has a heel end 36, a toe end 38 and an aft end 37. A shaft, not shown, is placed within an interior hosel 35 at the heel end 36. The interior hosel 35 is within the hollow interior 34 of the body 22, and the interior hosel 35 extends from the crown 24 to the sole 26. The interior hosel 35 is preferably cast with the entirety of the body 22. However, the interior hosel 35 may be a separate component that is attached through welding or other means to the body 22. Those skilled in the art will recognize that the golf club head 20 of the present invention alternatively may have an external hosel 15, such as shown in FIGS. 10–11, without departing from the scope and spirit of the present invention.

In a preferred embodiment, the golf club head 20 preferably has a striking plate insert 40 that is attached to the body 22 over the opening 32 of the front wall 30. As shown in FIG. 1, the striking plate insert 40 is preferably welded to the front wall 30 of the body 22, thereby covering the opening 32. A plurality of tabs 47, preferably three, align the striking plate insert 40 for the welding process. Alternatively, the striking plate insert 40 is press-fitted into the opening 32. As shown in FIG. 1, the striking plate insert 40 typically has a plurality of score-lines 45 thereon.

Figure 15:
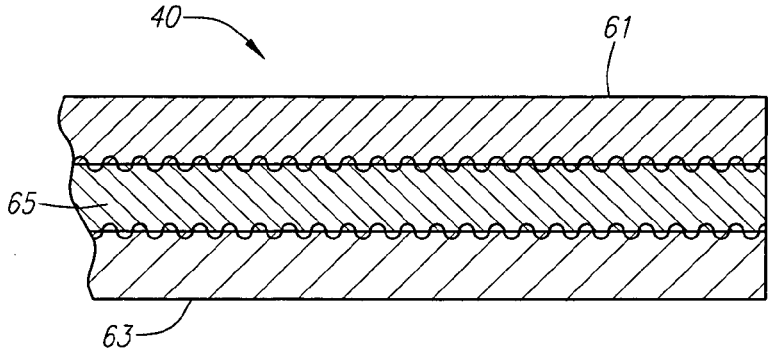
FIG. 15 is an enlarged detail of the sectional view of FIG. 14.

As shown in FIG. 15, the striking plate insert 40 is preferably composed of a first layer 61, a second layer 65 and a third layer 63. The first layer 61 and the third layer 63 are preferably composed a high strength material such as a titanium alloy material, a steel alloy material, a beryllium-copper material, or a forging brass. Each of the first layer 61 and the third layer 63 preferably has a thickness ranging from 0.025 inch to 0.200 inch, more preferably 0.050 inch to 0.150 inch, and most preferably 0.060 inch. The second layer 65 is preferably composed of a low density material such as an aluminum alloy, aluminum, pure titanium, magnesium alloys, and other like material. The second layer 65 preferably has a density less than 5.0 grams per cubic centimeter ("g/cc"), and more preferably less than 3.0 g/cc. The second layer preferably has a thickness ranging from 0.025 inch to 0.200 inch, more preferably 0.050 inch to 0.150 inch, and most preferably 0.060 inch.

Figure 13:
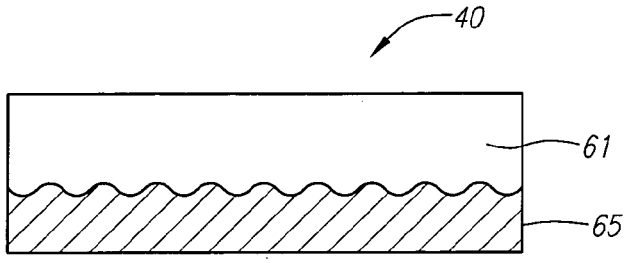
FIG. 13 is a cross-sectional view of an alternative embodiment of a laminated explosion bonded striking plate insert.

Alternatively, the striking plate insert 40 comprises only two layers as shown in FIG. 13. The first layer 61 is preferably composed a high strength material such as a titanium alloy material, a steel alloy material, a beryllium-copper material, or a forging brass. The first layer 61 preferably has a thickness ranging from 0.025 inch to 0.200 inch, more preferably 0.050 inch to 0.150 inch, and most preferably 0.060 inch. The second layer 65 is preferably composed of a low density material such as an aluminum alloy, aluminum, pure titanium, magnesium alloys, and other like material. The second layer 65 preferably has a density less than 5.0 grams per cubic centimeter ("g/cc"), and more preferably less than 3.0 g/cc. The second layer preferably has a thickness ranging from 0.025 inch to 0.200 inch, more preferably 0.050 inch to 0.150 inch, and most preferably 0.060 inch. This embodiment of the striking plate insert 40 is particularly suitable for use with a club head including a backing plate 45 such as shown in FIG. 11.

Figure 12:
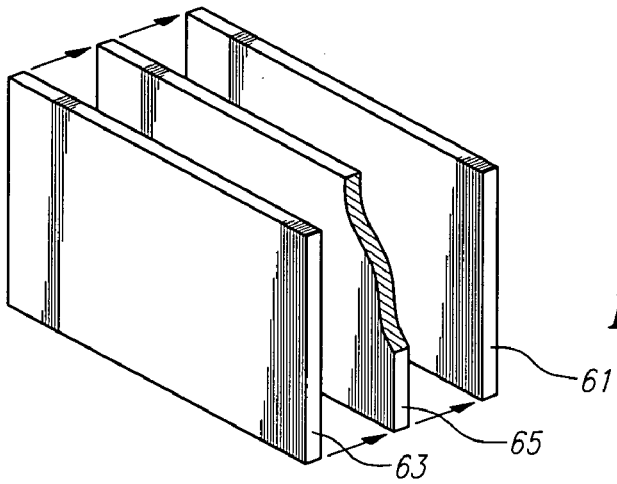
FIG. 12 is an exploded view of a preferred embodiment of a laminated insert.
Figure 13A:
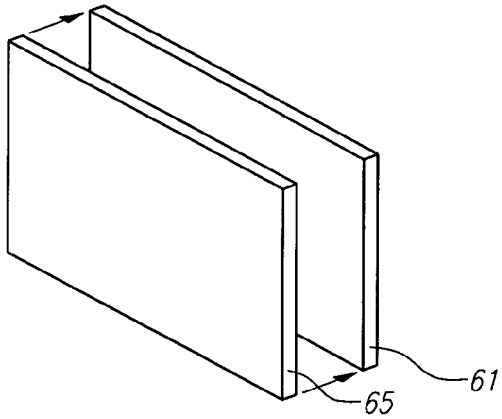
FIG. 13A is an exploded view of an alternative embodiment of a laminated insert.

The materials of the laminate are preferably joined by explosion bonding or welding to form a finished striking plate insert 40. According to a preferred embodiment, the layers are initially arranged in spaced relation as shown in FIGS. 12 and 13. In FIG. 12, the first layer 61 forms the striking face of the golf club head 20, and the third layer 63 forms the rear face of the striking plate insert 40. An explosive is applied to the rear surface of the rear third layer 63 and a detonator is connected with the explosive. When the detonator is activated, the explosive accelerates the third layer 63 into bonding contact with the second or center layer 65 which is then accelerated into bonding contact with the front first layer 61, as shown by the arrows between the layers of FIG. 12. A similar arrangement is shown in FIG. 13, where the first layer 61 forms the striking face of the golf club head, and the second layer 65 forms the rear face of the striking plate insert 40. An explosive is applied to the rear surface of the rear second layer 65 and a detonator is connected with an explosive. When the detonator is activated, the explosive accelerates the rear second 65 into bonding contact with the first layer 61, as shown by the arrows in FIG. 13A. Those skilled in the art will recognize other methods for explosion bonding non-similar materials.

Figure 14:
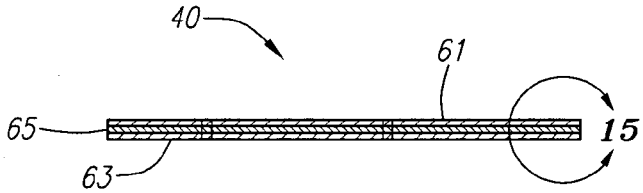
FIG. 14 is a cross-sectional view of a preferred embodiment of a laminated explosion bonded striking plate insert.

Explosion bonding provides metal-to-metal bonding between the layers without generating excessive heat in the layers. In FIG. 14 is shown the explosive bonded layers 61, 63, and 65 of the laminate of FIG. 12.

The spacing between the layers prior to explosion bonding is a function of the materials being bonded. Typically, the distance is from 0.5 to 4 times the thickness of the layers. For example, an arrangement with two outside layers of a high strength material such as 6-4 titanium with a thickness of approximately 0.06 inch (1.5 mm) and an inner layer of less dense material such as aluminum with a similar thickness of approximately 0.06 inch (1.5 mm) would require a spacing between the layers prior to explosion from 0.03 inch (0.75 mm) to 0.24 inch (6.0 mm). When the explosive is ignited, the detonation travels across the surface of the third layer 63 and the gas expansion of the explosion accelerates the third layer 63 toward the second layer 65. Because of the rapid movement of the third layer toward the second layer, pressure is created at the opposing surfaces of the layers to remove surface contaminants therefrom, resulting in a metal-to-metal bond between the clean metal surfaces when the outer layer collides with the inner layer. The same occurs between the second layer 65 and the front first layer 61.

As shown in FIG. 15, the interfaces between the explosion bonded layers have a wavy bond morphology. The metallurgical bond results from the interface between the grains of the different metal layers. Although the explosion bonding process generates heat, the heat is not transferred to the metal layers, because bonding occurs so quickly. Thus, there is no melting or diffusion of the layers. Accordingly, high yield strengths are obtained. Typically, the yield strength of the laminate is similar to or greater than the full strength characteristics of the materials used in the laminate.

In a preferred embodiment, the striking plate insert 40 has a uniform thickness that ranges from 0.050 inch to 0.250 inch, more preferably a thickness of 0.080 inch to 0.120 inch, and is most preferably approximately 0.110 inch.

The present invention is directed at a golf club head that has a high coefficient of restitution thereby enabling for greater distance of a golf ball hit with the golf club head of the present invention. The coefficient of restitution (also referred to herein as COR) is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head 20 preferably having a coefficient of restitution preferably ranging from 0.80 to 0.94, and more preferably from 0.82 to 0.87, and most preferably from 0.84 to 0.85, as measured under standard USGA test conditions.

The depth, "D", of the club head 20 from the striking plate insert 40 to the aft-end 37 preferably ranges from 3.0 inches to 4.5 inches, and is most preferably 3.75 inches. The height, "H", of the club head 20, as measured while in address position, preferably ranges from 2.0 inches to 3.5 inches, and is most preferably 2.50 inches or 2.9 inches. The width, "W", of the club head 20 from the toe end 38 to the heel end 36 preferably ranges from 4.0 inches to 5.0 inches, and more preferably 4.7 inches.

Figure 9:
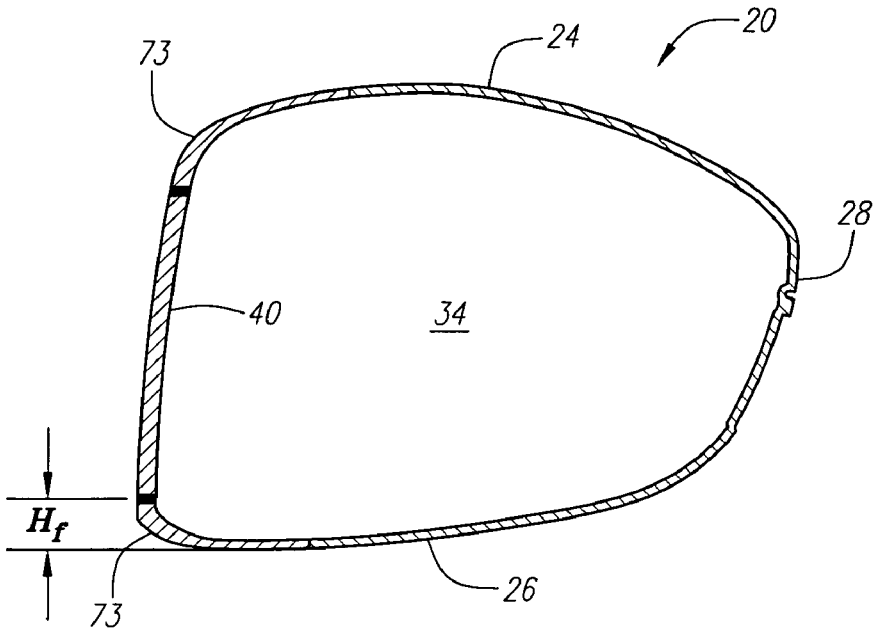
FIG. 9 is a cross-sectional view along line 9—9 of FIG. 3.

As shown in FIG. 9, the distance, "Hf", between the lowest point of the sole 26 when the golf club head 20 is in the address position and the lowest point of the striking plate insert 40 is preferably approximately 0.5 inch. Further, the weld between the striking plate insert 40 and the body 22 is preferably approximately 0.03 inch, which provides for a more compliant face resulting in a higher COR.

The center of gravity and the moments of inertia of the golf club head 20 may be calculated as disclosed in U.S. Pat. No. 6,607,452, entitled High Moment Of Inertia Composite Golf Club, and hereby incorporated by reference in its entirety. In general, the moment of inertia, Izz, about the Z axis of the center of gravity for the golf club head 20 will preferably range from 2700 g-cm$^2$ to 4000 g-cm$^2$, more preferably from 3400 g-cm$^2$ to 3900 g-cm$^2$. The large Izz value improves shot straightness and distance for heel-toe hits. The moment of inertia, Iyy, about the Y axis for the center of gravity of the golf club head 20 will preferably range from 2000 g-cm$^2$ to 3000 g-cm$^2$. The large Iyy value improves the backspin robustness and distance for both high and low hits on the face.

The following is a list of examples of materials that can be used for the layers of the insert:

| MATERIAL | TENSILE STRENGTH (psi) | YIELD STRENGTH (psi) | DENSITY (lb/cu. in.) |
|---|---|---|---|
| 356 Aluminum | 40000 | 27000 | 0.097 |
| 7075 Aluminum | 83000 | 73000 | 0.101 |
| Forging Brass | 55000 | 20000 | 0.305 |
| BE-CU | 110000 | 90000 | 0.297 |
| 304 Stainless | 85000 | 35000 | 0.290 |
| 431 Stainless | 125000 | 95000 | 0.280 |
| 17-4 Stainless | 150000 | 110000 | 0.280 |
| 99.0% Titanium | 79000 | 63000 | 0.163 |
| 6-4 Titanium | 135000 | 120000 | 0.160 |

Examples of some of the above materials for construction of the laminate are as follows:

| FACE LAYER | CENTER LAYER | BACK LAYER |
|---|---|---|
| 17-4 Stainless | 99.0% Titanium | 17-4 Stainless |
| 6-4 Titanium | 7075 Aluminum | 6-4 Titanium |
| BE-CU | 356 Aluminum | BE-CU |

-continued

| FACE LAYER | CENTER LAYER | BACK LAYER |
|---|---|---|
| Forging Brass | 256 Aluminum | Forging Brass |
| 431 Stainless | 7075 Aluminum | 17-4 Stainless |
| 304 Stainless | 356 Aluminum | 7075 Aluminum |
| 431 Stainless | 7075 Aluminum | 431 Stainless |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club head comprising:

a body having a crown, a sole, a ribbon and a front wall with an opening, the crown having a thickness of 0.035 inch to 0.045 inch, the sole having a thickness of 0.035 inch to 0.045 inch, the body composed of a cast titanium alloy material, the crown the sole, the ribbon and the front wall defining a hollow interior; and a striking plate insert comprising a first layer and a second layer, the first layer composed of titanium material, the first layer providing an outer striding face of the golf club head, the second layer composed of an aluminum material and having a lower yield strength than the yield strength of the first layer, the first layer and the second layer joined by an explosion bonding process, whereby the yield strength of the striking plate insert in its entirety is greater than the yield strength of each of the first layer and the second layer; and an internal hosel positioned within the hollow interior of the body, the internal hosel extending from the crown toward the sole, wherein the golf club head has a volume ranging from 200 cubic centimeters to 500 cubic centimeters, a mass less than 225 grams, a height ranging from 2.0 inches to 3.5 inches, a width ranging from 4.0 inches to 5.0 inches, a coefficient of restitution ranging from 0.82 to 0.94, a moment of inertia, Izz, about the Z axis through the center of gravity of the golf club head ranging from 3400 g-cm2 to 3900 g-cm$^2$.

2. The golf club head according to claim 1 wherein the striking plate insert further comprises a third layer composed of titanium material, wherein the second layer is disposed between the third layer and the first layer, and whereby the third layer and the second layer are joined by an explosion bonding process.

3. A golf club head comprising:

a body having a crown, a sole, a ribbon, and a front wall with an opening, the crown having a thickness of 0.035 inch to 0.045 inch, the sole having a thickness of 0.035 inch to 0.045 inch, the body composed of a cast metal material, the crown, the sole, the ribbon and the front wall defining a hollow interior; and a striking plate insert comprising a first layer providing an outer striking face of the golf club head and a second layer having a lower yield strength than the yield strength of the first layer, the first layer joined to the second layer by an explosion bonding process;

wherein the golf club head has a volume ranging from at least 360 cubic centimeters, a mass ranging from 180 grams to 215 grams, a height ranging from 2.0 inches to 3.5 inches, a width ranging from 4.0 inches to 5.0 inches, a depth ranging from 3.0 inches to 4.5 inches, a coefficient of restitution ranging from 0.82 to 0.94; and a moment of inertia, Izz, about the Z axis through the center of gravity of the golf club head ranging from 3400 g-cm$^2$ to 3900 g-cm $^2$.

4. The golf club head according to claim 3 wherein the body is composed of a cast titanium alloy material, the first layer of the striking plate insert is composed of titanium alloy material, and the second layer of the striking plate insert is composed of an aluminum material.

5. The golf club bead according to claim 3 wherein the body is composed of a cast steel alloy material, the first layer of the striking plate insert is composed of a stainless steel material, and the second layer of the striking plate insert is composed of an aluminum material.

6. The golf club head according to claim 3 wherein the striking plate insert further comprises a third layer composed of titanium material, the second layer disposed between the third layer and the first layer, the third layer joined to the second layer by an explosion bonding process.

7. A golf club head comprising:

a body having a crown and a sole, and a front wall with an opening; and a striking plate insert comprising a first layer providing an outer striking face of the golf club head and a second layer having a lower yield strength than the yield strength of the first layer, the first layer joined to the second layer by an explosion bonding process, the first layer having a thickness ranging from 0.050 inch to 0.150 inch, and the second layer having a thickness ranging from 0.050 inch to 0.150 inch;

wherein the golf club head has a volume ranging from at least 300 cubic centimeters to 500 cubic centimeters, a coefficient of restitution ranging from 0.80 to 0.94; and a moment of inertia, Izz, about the Z axis through the center of gravity of the golf club head greater than 3000 g-cm$^2$.

8. The golf club head according to claim 7 wherein the body is composed of a cast titanium alloy material, the first layer of the striking plate insert is composed of titanium alloy material, and the second layer of the striking plate insert is composed of an aluminum material.

9. The golf club head according to claim 7 wherein the body is composed of a cast steel alloy material, the first layer of the striking plate insert is composed of steel alloy material, and the second layer of the striking plate insert is composed of an aluminum material.

10. A golf club head comprising:

a body having a crown and a sole, and a front wall with an opening; and a striking plate insert comprising a first layer providing an outer striking face of the golf club head, a second layer having a lower yield strength than the yield strength of the first layer, and a third layer welded to the second layer, the first layer, the second layer and the third layer joined by an explosion bonding process, the first layer having a thickness ranging from 0.050 inch to 0.150 inch, the second layer having a thickness ranging from 0.050 inch to 0.150 inch, and the third layer having a thickness ranging from 0.050 inch to 0.150 inch;

wherein the golf club head has a volume ranging from at least 300 cubic centimeters to 500 cubic centimeters, a coefficient of restitution ranging from 0.80 to 0.94; and a moment of inertia, Izz, about the Z axis through the center of gravity of the golf club head greater than 3000 g-cm$^2$.

11. The golf club head according to claim 10 wherein the body is composed of a cast titanium alloy material, the first layer of the striking plate insert is composed of titanium alloy material, the second layer of the striking plate insert is composed of an aluminum material, and the third layer of the striking plate insert is composed of titanium alloy material.

12. The golf club head according to claim 10 wherein the body is composed of a cast steel alloy material, the first layer of the striking plate insert is composed of steel alloy material, the second layer of the striking plate insert is composed of an aluminum material, and the third layer of the striking plate insert is composed of steel alloy material.

13. The golf club head according to claim 10 wherein the body is composed of a cast steel alloy material, the first layer of the striking plate insert is composed of steel alloy material, the second layer of the striking plate insert is composed of a titanium material, and the third layer of the striking plate insert is composed of steel alloy material.

14. The golf club head according to claim 10 wherein the body is composed of a cast titanium alloy material, the first layer of the striking plate insert is composed of beryllium copper: material, the second layer of the striking plate insert is composed of an aluminum material, and the third layer of the striking plate insert is composed of beryllium copper material.

15. The golf club head according to claim 10 wherein the body is composed of a cast titanium alloy material, the first layer of the striking plate insert is composed of forging brass material, the second layer of the striking plate insert is composed of an aluminum material, and the third layer of the striking plate insert is composed of forging brass material.

16. The golf club head according to claim 10 wherein the body is composed of a cast steel alloy material, the first layer of the striking plate insert is composed of steel alloy material, the second layer of the striking plate insert is composed of an aluminum material, and the third layer of the striking plate insert is composed of aluminum material.

* * * * *